US007874118B2

(12) United States Patent
Schitter

(10) Patent No.: US 7,874,118 B2
(45) Date of Patent: Jan. 25, 2011

(54) PANEL WITH PROTECTED V-JOINT

(75) Inventor: Leonhard Schitter, Hallwang (AT)

(73) Assignee: Kaindl Flooring GmbH, Wals/Salzburg (AT)

( * ) Notice: Subject to any disclaimer, the term of this patent is extended or adjusted under 35 U.S.C. 154(b) by 1029 days.

(21) Appl. No.: 10/921,534

(22) Filed: Aug. 19, 2004

(65) Prior Publication Data

US 2005/0050827 A1 Mar. 10, 2005

(30) Foreign Application Priority Data

Sep. 5, 2003 (DE) ..... 203 13 661 U

(51) Int. Cl.
*E04C 3/00* (2006.01)

(52) U.S. Cl. ..... 52/578; 52/588.1; 52/581

(58) Field of Classification Search ..... 52/578, 52/588.1, 581
See application file for complete search history.

(56) References Cited

U.S. PATENT DOCUMENTS 6,332,733 B1 * 12/2001 Hamberger et al. ..... 403/329
6,865,856 B2 * 3/2005 Kim et al. ..... 52/592.1
2002/0020127 A1 * 2/2002 Thiers et al. ..... 52/403.1
2003/0024199 A1 * 2/2003 Pervan et al. ..... 52/589.1
2004/0016196 A1 * 1/2004 Pervan ..... 52/578
2004/0031225 A1 * 2/2004 Fowler ..... 52/578

FOREIGN PATENT DOCUMENTS

WO WO 01/96688 A1 * 12/2001

* cited by examiner

*Primary Examiner*—Basil Katcheves
*Assistant Examiner*—Branon C Painter
(74) *Attorney, Agent, or Firm*—Pearne & Gordon LLP

(57) ABSTRACT

A laminated panel adapted to form a covering for a wall, floor or ceiling has an outer surface and sides which are connected to an adjacent panel. The panel has a recess in the outer surface at the transition to a side, and a moisture-repellent layer on the wall of the recess. When two panels are connected the moisture-repellent layers come together at the recesses, to form a joint which is protected from moisture.

16 Claims, 4 Drawing Sheets

PANEL WITH PROTECTED V-JOINT

Figure 1:
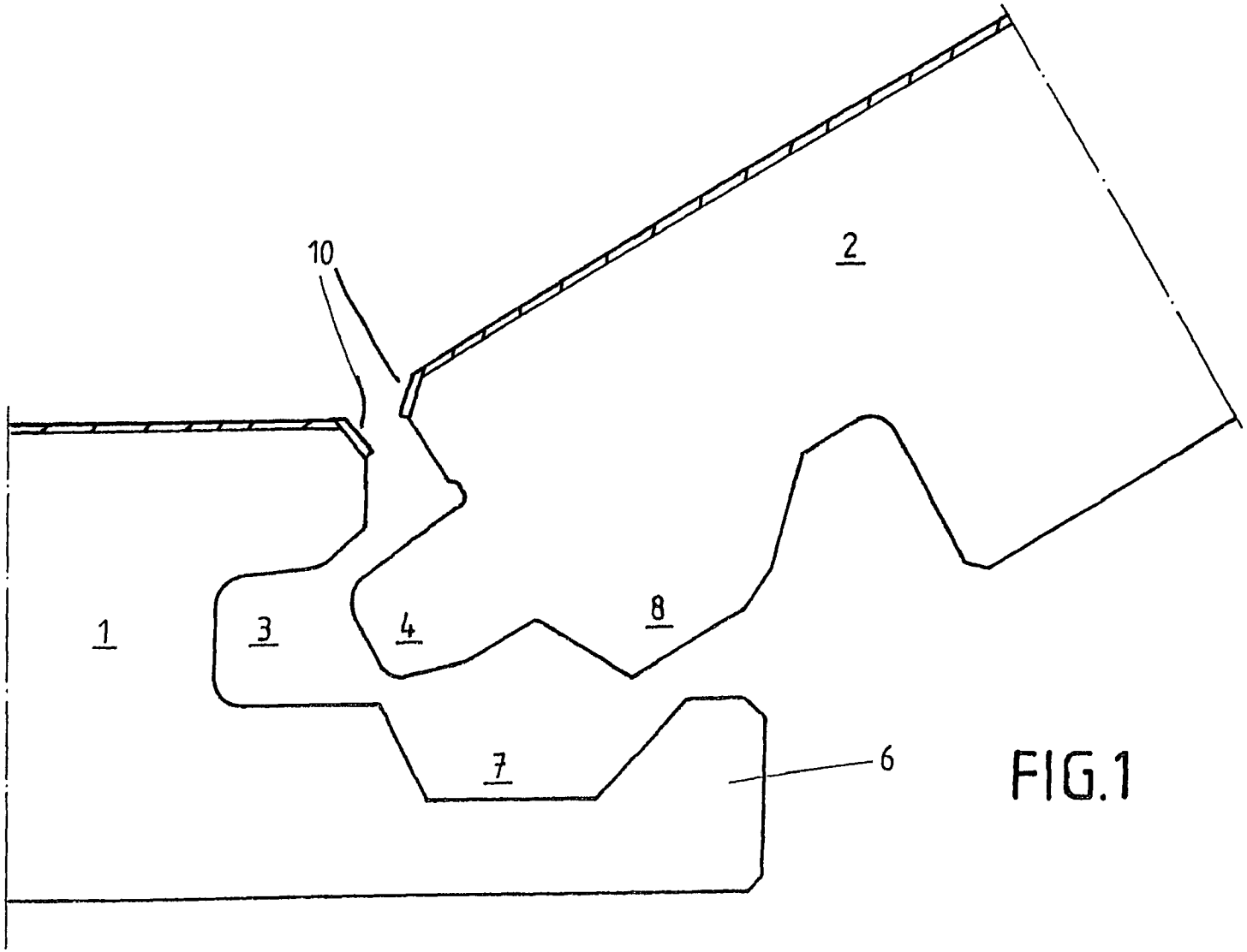

The invention relates to panels, in particular, laminated panels, which can form a covering. The covering may be used, for example, as a wall, floor or ceiling covering. The panels generally consist of wood or a wooden material, such as chipboard, HDF or MDF boards, synthetic material or materials of a synthetic type. A decorative layer is generally provided on an upper side of the panels to give the covering the required appearance. The decorative layer may be formed from printed paper. However, the decorative layer may also consist of natural wood or similar materials. If the decorative layer is made of printed paper, a transparent layer, which typically contains resin and abrasion-resistant particles such as corundum, aluminium oxide or silicon carbide, is generally disposed above the paper to protect against moisture and/or abrasion. A so-called counteracting paper, which is impregnated with resin, or a layer made from natural wood or another material intended to prevent the distortion of the panel, is then generally provided below the panel.

When the panels are joined to form a covering, the joints at the upper side with the decoration may comprise recesses. These are generally provided for visual reasons. A recess of this kind is disclosed in DE 381 9245 A1. However, technical advantages are also indicated, for example, to simplify a lateral connection of two panels by rotary movement, as described, for example, in WO 01/96688 A1. Lateral milling can be used to provide, in addition to the recess, coupling means such as tongues and grooves for a positive vertical connection, and other locking means for a positive horizontal connection. By contrast with the adjacent upper surface, the region of the recess is, in this case, not protected against moisture and not provided with decoration.

To create the v-joint known from WO 01/96688 A1 in a decorative manner, this is printed separately after milling, and indeed, preferably with a water-resistant material, in order to guarantee protection against moisture at the same time. The butt ends and transitions are relatively sensitive to the penetration of water and/or moisture.

The object of the present invention is to provide panels of the type named above with moisture protection at the joints.

According to the invention, the recesses already known from WO 01/96688 A1, which are adjacent to the surface, are preferably not merely printed, but a moisture-repellent layer is provided by varnishing or painting over their entire surface, or a resilient material is applied. The varnish or the resilient material, such as rubber or silicon, is applied uniformly over the entire surface. In one advantageous embodiment, the varnish, paint or layer of resilient material extends into the interior of a joint, thereby ensuring that when two panels are connected to one another, it is not the butt ends of a printed decoration that are in contact with one another; on the contrary, varnished or painted layers are pressed against one another over their entire surface and therefore achieve a reliable connection. By comparison with the prior art, the particularly critical region at the bottom of a recess at the boundary between two panels is therefore better protected against moisture.

In an alternative advantageous embodiment of the invention, moisture-repellent varnish or paint layers and, in particular, layers made from resilient material are applied with a thickness such that, in the connected condition of two panels, two of these layers are pressed against one another and therefore ensure a particularly tightly sealed connection between two panels. When a strip or printing is attached, as in the prior art, by gluing, one strip may not be pressed against the other strip, or respectively, one printed colour may not be pressed against the other printed colour, regions of the panel disposed relatively lower being in particularly close contact with one another instead. As a result, penetrating moisture can damage a region of the panels, which is visible from the surface. By contrast, the present invention ensures that varnished layers or layers made from resilient material are pressed against one another in the critical transitional region between one panel and another thereby achieving improved protection against moisture.

The layer is advantageously at least 1/10 of a millimeter thick, most advantageously several tenths of a millimeter thick. If the material behaves in a flexible and/or resilient manner, then a layer thickness of several tenths of a millimeter is preferable. In this case, the layer thickness is preferably at lease 3/10 mm, by particular preference at least 5/10 mm thick.

The moisture-repellent layer is applied especially after a lateral milling of coupling elements. Accordingly, the moisture-repellent layer cannot be damaged retrospectively by subsequent processing stages.

Figure 2:
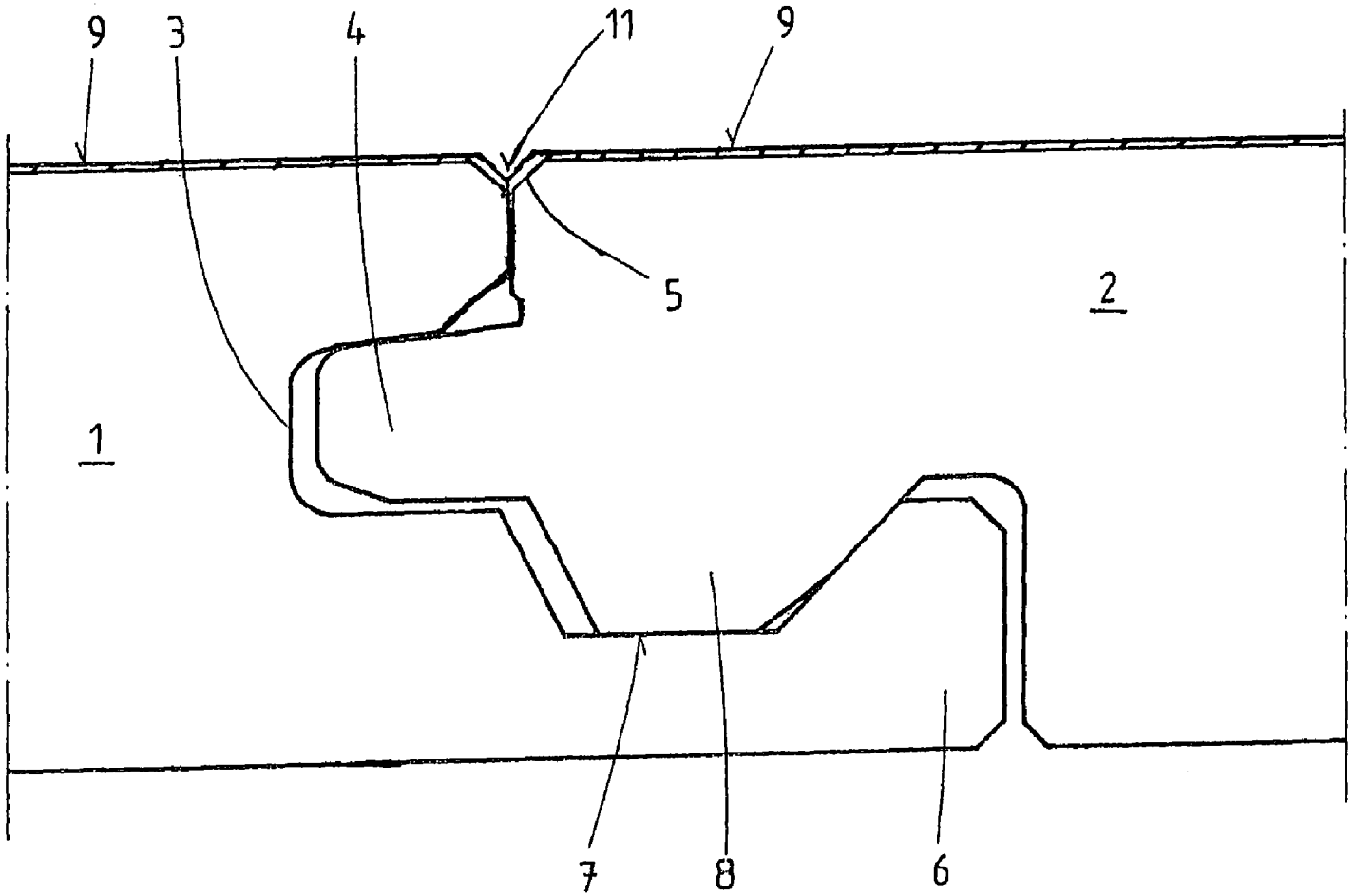
Figure 3:
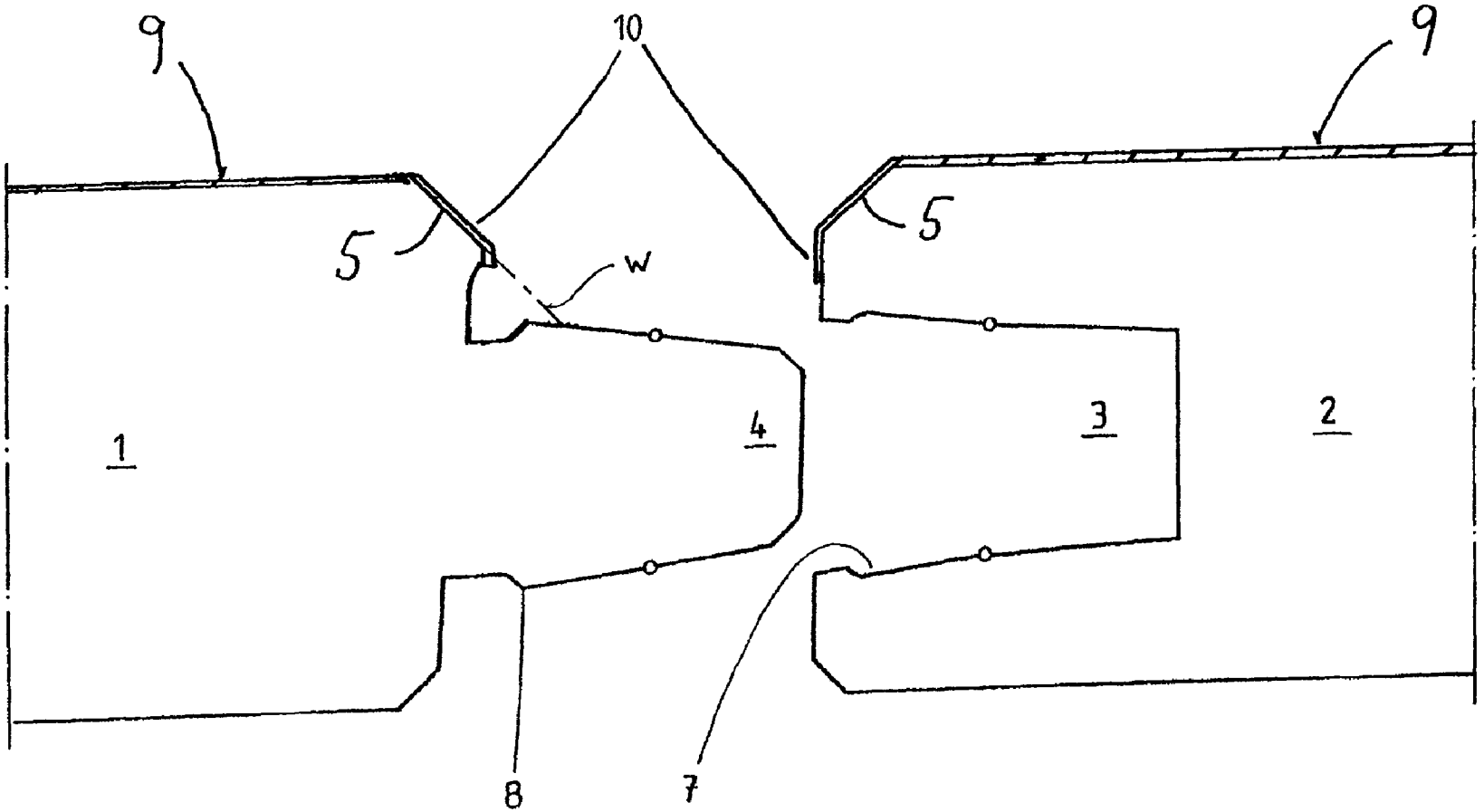
Figure 4:
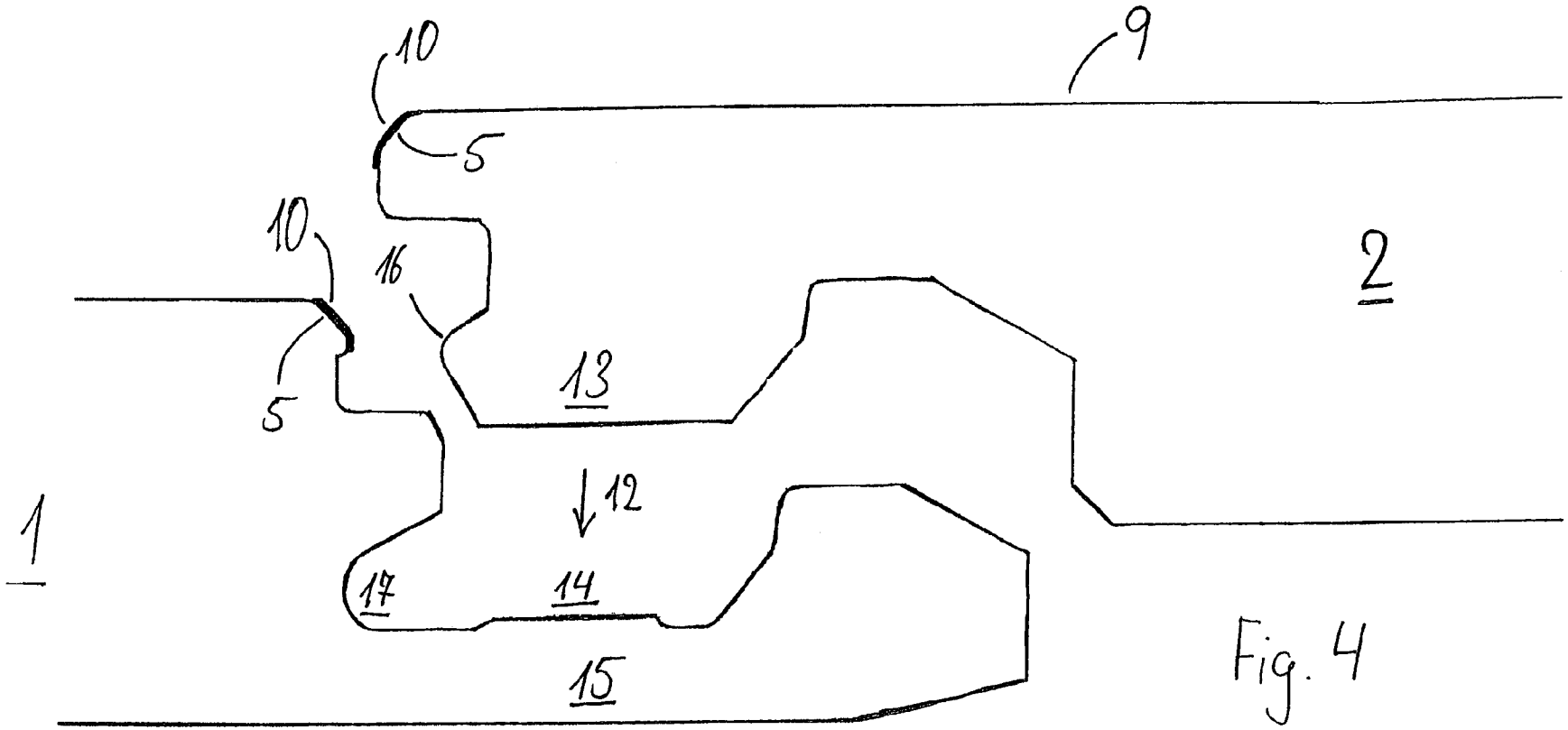

The invention is explained in greater detail below with reference to exemplary embodiments. The drawings are as follows:

FIG. 1: shows panels with a v-joint and a layer made from resilient material;

FIG. 2: shows panels as illustrated in FIG. 1 in the connected condition;

FIG. 3: shows panels with a v-joint and a varnished layer;

FIG. 4: shows panels with a v-joint suitable for connection to one another by a movement perpendicular to the plane of the panels.

The drawings illustrate panels 1 and 2, which can be connected to one another by positive connection in the vertical direction, that is to say, perpendicular to the surface of the covering, by means of a groove 3 and a tongue 4. Further locking elements 7 and 8 provide a positive connection between two panels in a horizontal direction parallel to the surface. The panels have recesses 5, which, in the connected condition of two panels provide a v-shaped cross-section. In decorative terms, however, cross-sections with shapes other than a v-shape can also be provided. For instance, recesses which are curved towards the outside are also popular.

The groove 3 can have a protruding lip 6, so that locking elements 7 and 8 can be provided outside the groove, as illustrated in FIGS. 1 and 2. This feature is advantageous, because more space is provided and the panels can be connected particularly firmly to one another by a positive connection. A particularly strong connection is achieved, if two panels can be connected to one another by a rotating movement, as shown in FIGS. 1 and 2, but not by displacing the panels in one plane.

With the embodiment shown in FIG. 3, panels can be connected to one another by displacement in one plane. This simplifies handling to some extent, when the short sides of the panels are connected to one another. Waste materials are also minimised. The manufacturing costs of the embodiment shown in FIG. 3 with the arms of the groove 3 of the same length are therefore reduced.

At the visible side of the covering, the panels have a decorative layer 9. The decoration may comprise a printed paper or wood. Below the panels 1 and 2, a layer acting as a counteracting layer, which is similar in structure to the decorative layer, is generally provided to prevent distortion.

According to the invention, the walls of the recess are provided with a moisture-repellent varnish and/or paint layer or a moisture-repellent layer made from flexible, resilient material 10 such as silicon. This layer is preferably applied after the milling of the coupling elements 3, 4, 7, 8 and the recesses 5. If the layer 10 is sufficiently thick, this will guarantee that the layers are pressed firmly against one another at the bottom 11 of the recess. Particularly good moisture protection is therefore provided in this critical transitional region. It is therefore sufficient, if only the walls of the recess are provided with the protective layer 10. This applies in particular, if the layer consists of a flexible and/or resilient material. Application in a uniform manner over the entire surface ensures that the recess is protected over the entire surface.

In the case of the embodiment of the panels shown in FIGS. 1 and 2, the recesses 5 advantageously simplify connection by rotary movement.

With the embodiment shown in FIG. 3, the moisture-repellent layer 10 not only covers the walls of the recess 5, but reaches into the interior of the joint. If the panels 1 and 2 shown in FIG. 3 are connected to one another, then not only do the edges of the layer 10, which, with an inadequate layer thickness generally fail to contact one another sufficiently tightly, butt against one another; the layers 10 inside the joint 10 are in contact over their entire surface. Even if moisture penetrates into the interior of the joint, the moisture can only reach the interior of the joint at the transition between a panel 1 or 2 and the layer 10. This transition from the layer 10 to the region of a panel disposed behind it is not visible from the surface. Accordingly, even if moisture penetrates into the interior of the joint in spite of the surfaces pressed against one another, a comparatively moisture-sensitive region, which is not visible from the outside, will be affected. In this embodiment, the moisture-sensitive region is provided by an associated coupling element or tongue 4 that extends below the joint since the element or tongue is intersected by a plane "W" (FIG. 3) of the surface of the bevel 5. Accordingly, the covering retains its most important function of providing a decorative appearance when viewed from the surface.

Panels, which can be connected to one another in a non-glued manner by a movement perpendicular to the plane of the panel, are provided alongside the embodiments shown in FIGS. 1 to 3. This should be understood to mean that a panel 2 is held parallel to a panel 1, as shown in FIG. 4. When the coupling elements are disposed appropriately one above the other, and the panel 2 is moved in the direction of the arrow 12, while retaining the parallel position, the coupling elements ultimately interlock with one another. The two panels 1 and 2 are then connected by a positive connection. Amongst other features, patent specification DE 202 06 751.3 discloses panels of this kind.

With a method of connection of the above kind, it is particularly relevant that the surface, especially in the region of the joint, can be damaged by the movement. With embodiments of this kind, it is therefore advantageous to provide recesses 5 with the decoration at the joint adjacent to the surface. In this manner, damage to the rectangular edges, which are particularly at risk as specified in the prior art, is avoided. If a varnish or paint is applied, any damage which occurs can be repaired without difficulty, especially because the recess is typically badly illuminated, so that damage or subsequent repairs are hardly visible anyway. If a resilient layer is applied, this critical region is protected particularly well against accidental impact.

Apart from the recesses, the embodiment shown in FIG. 4 is already known from document DE 202 06 751.3. The peculiarities and advantages of these coupling elements are described in detail below. As a result of the movement into position, a downward-pointing coupling element 13 of the panel 2 enters a corresponding recess 14, which is provided in a projecting lower flank 15 of panel 1. As a result, the panels 1 and 2 are locked by a positive connection parallel to the surface 9 and perpendicular to the common joint. An upwardly-projecting, lateral tongue 16 of the panel 2 finally engages in a corresponding recess 17 of the panel 1. In this manner, the two panels are locked together perpendicular to the surface 9. One special feature of the embodiment of FIG. 4 is that the tongue 16 projects laterally less far than the surface region disposed above it. As a result, damage in the surface region is prevented in a further improved manner.

It is particularly advantageous, if coupling elements, which are connected to one another by rotary movement, are provided on the long sides of the panels. Coupling elements of this kind are disclosed in FIGS. 1 and 2. Coupling elements, which can be connected to one another by a movement perpendicular to the plane of the panel, are then preferably provided on the short sides. In this manner, three panels can be connected to one another in a particularly stable manner at the same time through a rotary movement; two panels being, in fact, connected by rotary movement at the long sides and, at the same time, the panel which is rotated being connected at the narrow sides to an adjacent third panel. The recesses 5 then prevent any accidental damage to the joints in the surface region both at the long sides and also at the short sides.

What is claimed is:

1. A panel for forming a covering, the panel having an outer surface, sides including lateral coupling elements to connect adjacent panels to form a covering, a recess provided in said outer surface at a transition from said outer surface to an adjacent side of the panel, said sides including lateral regions that form an interior joint when the panel is connected to an adjacent panel, the joint being remote of said outer surface, and a moisture-repellent layer extending continuously along said recess and an adjacent one of said lateral regions, said moisture-repellant layer having a thickness of at least about 0.5 mm, portions of said moisture-repellant layer having their thicknesses projecting from said adjacent sides of the panel in said lateral region, said thickness of said moisture repellant layer being chosen such that said portions are pressed together to form abutting seal layers that are in sealing contact and provide a watertight seal for preventing moisture flow into and along said interior joint when adjacent panels are connected, said recess having a surface that lies in a plane that intersects an associated one of said coupling elements extending below said abutting seal layers wherein the coupling elements contact any moisture leaking through said abutting seal layers, wherein a transition area from the moisture-repellent layer to a region of the panel that does not include the moisture-repellant layer is located below the plane and the transition area is not visible from the outer surface, wherein said abutting seal layers have complementary faces that fully engage when said adjacent panels are connected, and wherein said sides include tongue and groove connections that are arranged for connection by a movement perpendicular to the plane of the panel, and said tongue does not extend beyond said complementary faces.

2. A panel according to claim 1, wherein said moisture-repellent layer is selected from the group consisting of a varnish, a paint or a layer made from a flexible and/or resilient material.

3. A panel according to claim 1, including a decorative layer forming said outer surface.

4. A panel according to claim 1, wherein said recess is a bevel, and adjacent panel bevels cooperate to form a V-shape joint.

5. A panel according to claim 1, wherein said moisture-repellent layer is formed by an application of varnish of substantially uniform color over said outer surface.

6. A panel according to claim 1, wherein said lateral coupling elements are connected to one another by a positive connection.

7. A panel according to claim 1, wherein said moisture-repellent layer is formed of a material selected from the group consisting of silicone or rubber.

8. A panel according to claim 1, wherein said panel is formed predominantly of a wooden material.

9. A panel according to claim 1, wherein said sides are arranged for connection to another panel by a rotary movement about a common joint.

10. A panel according to claim 1, wherein said sides are arranged for connection to another panel by displacement in the plane of the panel.

11. A panel according to claim 1, wherein said covering has a generally planar upper surface formed by said outer surfaces and recesses of connected panels, said upper surface being exposed to view when said covering is in use, and said complementary faces are not exposed to view when said covering is in use.

12. A panel according to claim 11, wherein said recess is a bevel, adjacent panel bevels cooperate to form a V-shape, said complementary faces have substantially flat contours, and said complementary faces are disposed below said V-shape.

13. A panel according to claim 12, wherein said complementary faces are substantially perpendicular to said planar upper surface.

14. A floor covering, formed from panels according to claim 1.

15. A floor covering according to claim 14, wherein decoration is formed by a printed paper layer, covered by an abrasion-resistant transparent layer.

16. A covering system comprising two or more panels, each said panel having an outer surface and sides including lateral coupling elements to connect adjacent panels, a recess including a wall provided in said outer surface at a transition from said outer surface to an adjacent side of said panel, and a moisture-repellent layer having a thickness of at least about 0.5 mm extending continuously along said wall of said recess and an associated lateral region of said panel side, such that when adjacent panels are connected together at a joint, said recesses are adjacent and cooperate to form said joint in said outer surface and said associated lateral regions cooperate to form an interior portion of said joint, and said moisture-repellent layers extending along said associated lateral regions and projecting from adjacent sides of said panels form abutting seal layers having complementary faces that fully engage when said adjacent panels are connected to provide a sealing connection at said interior portion of said joint for preventing moisture flow into and along said interior portion of said joint, said recess having a surface that lies in a plane that intersects an associated one of said coupling elements extending below said abutting seal layers wherein the coupling elements contact any moisture leaking through said abutting seal layers, and further comprising a transition area from the moisture-repellent layer to a region of the panel that does not include the moisture-repellant layer is located below the plane and the transition area is not visible from the outer surface, wherein said sides include tongue and groove connections that are arranged for connection by a movement perpendicular to the plane of the panel, and said tongue does not extend beyond said complementary faces.

* * * * *